US012085278B2

(12) United States Patent
Martin et al.

(10) Patent No.: US 12,085,278 B2
(45) Date of Patent: Sep. 10, 2024

(54) SYSTEMS AND METHODS TO PREVENT EXPLOSIONS IN A TANK USING AUTOMATED GAS HARVESTING AND PURGE SAFETY DEVICES

(71) Applicant: Halliburton Energy Services, Inc., Houston, TX (US)

(72) Inventors: Adam Harold Martin, Carrollton, TX (US); Mark McGouldrick, Arbroath (GB); Daniel Joshua Stark, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 342 days.

(21) Appl. No.: 17/716,369

(22) Filed: Apr. 8, 2022

(65) Prior Publication Data

US 2023/0324046 A1 Oct. 12, 2023

(51) Int. Cl.

| | |
|---|---|
| ***F23N 5/24*** | (2006.01) |
| ***E21B 21/06*** | (2006.01) |
| ***E21B 34/02*** | (2006.01) |
| ***E21B 43/12*** | (2006.01) |
| ***E21B 43/26*** | (2006.01) |

(52) U.S. Cl.

CPC ..... *F23N 5/245* (2013.01); *F23N 2231/04* (2020.01); *F23N 2231/28* (2020.01); *F23N 2235/24* (2020.01); *F23N 2235/30* (2020.01)

(58) Field of Classification Search

CPC ..... F23N 5/24

See application file for complete search history.

(56) References Cited

U.S. PATENT DOCUMENTS

| | | | |
|---|---|---|---|
| 4,126,184 | A | 11/1978 | Hinrichs |
| 4,142,851 | A | 3/1979 | Handa |
| 4,267,889 | A | 5/1981 | Williams |
| 4,802,502 | A | 2/1989 | Williams |

(Continued)

FOREIGN PATENT DOCUMENTS

| | | | |
|---|---|---|---|
| CA | 2465735 | A1 | 10/2005 |
| WO | 9401722 | A1 | 1/1994 |
| WO | 9717522 | A1 | 5/1997 |

OTHER PUBLICATIONS

Cunliffe, B. J., "Avoiding Explosions by Means of Inerting Systems," Chilworth Technology Limited, Symposium Series No. 148, 2001, 14 pages.

*Primary Examiner* — Matthew R Buck
*Assistant Examiner* — Douglas S Wood
(74) *Attorney, Agent, or Firm* — John Wustenberg; Parker Justiss, P.C.

(57) ABSTRACT

Provided is a flowback system and method. The flowback system, in one aspect, include a tank, a transfer pump, a low-pressure vent line coupled between a vent of the tank and a first flare tip, and a high-pressure gaseous hydrocarbon line coupled to a second flare tip. In accordance with yet one other aspect, the flowback system includes a control system including a sensor, a valve and a valve controller coupled to the valve, the valve of the control system coupled between the low-pressure vent line and the high-pressure gaseous hydrocarbon line, the control system configured to sense an unsafe system event and actuate the valve to supply high-pressure gaseous hydrocarbons from the high-pressure gaseous hydrocarbon line to the low-pressure vent line.

35 Claims, 9 Drawing Sheets

(56) References Cited

U.S. PATENT DOCUMENTS

| | | | | |
|---|---|---|---|---|
| 5,829,964 | A | 11/1998 | Derrick et al. | |
| 5,992,544 | A | 11/1999 | Sprehe | |
| 8,485,040 | B2 | 7/2013 | Petersen | |
| 8,667,977 | B1 | 3/2014 | McCaul et al. | |
| 8,992,838 | B1 * | 3/2015 | Mueller | B01J 8/001 422/129 |
| 9,273,543 | B2 | 3/2016 | Baca et al. | |
| 9,334,109 | B1 * | 5/2016 | Mueller | C10G 5/06 |
| 9,776,155 | B1 * | 10/2017 | Mueller | B01J 8/0496 |
| 10,989,407 | B1 * | 4/2021 | Bacon | F23G 7/085 |
| 2006/0015266 | A1 | 1/2006 | Going et al. | |
| 2011/0132592 | A1 * | 6/2011 | Apple | E21F 7/00 166/65.1 |
| 2012/0325751 | A1 * | 12/2012 | Renick | E21B 21/067 210/85 |
| 2013/0228330 | A1 * | 9/2013 | Loree | E21B 43/2607 166/57 |
| 2014/0370448 | A1 * | 12/2014 | Aldrich | F23G 7/085 431/284 |
| 2016/0047216 | A1 * | 2/2016 | Rajewski | F23G 7/08 29/897.3 |
| 2017/0324098 | A1 * | 11/2017 | Mack | H01M 50/437 |
| 2023/0287764 | A1 * | 9/2023 | Nickerson | E21B 41/0021 |

* cited by examiner

SYSTEMS AND METHODS TO PREVENT EXPLOSIONS IN A TANK USING AUTOMATED GAS HARVESTING AND PURGE SAFETY DEVICES

BACKGROUND

During a hydraulic fracturing ("fracking") treatment, hydraulic fracturing fluid is introduced into a well under high pressure to create cracks or fractures in the reservoir rock through which trapped hydrocarbons (e.g., natural gas and/or petroleum) and connate water can flow from the rock more freely. Following the hydraulic fracturing treatment, and before placing the well into production, a process commonly referred to as "flowback" is commenced. During flowback, the elevated pressure in the reservoir caused by introducing the pressurized hydraulic fluid is reduced or "drawn down," allowing fluids (for example including the hydraulic fracturing fluids and components thereof (e.g., proppant), liquid hydrocarbons (e.g., petroleum oil), gaseous hydrocarbons (e.g., natural gas) and connate water) to flow from the well back to the surface.

In certain situations, a flowback system and/or a surface well testing system may be employed to receive the flowback, whether that be from a fracking operation, a well testing operation, or any other operation. The surface well testing system may then use the collected flowback, and any information obtained therefrom, to compile full and reliable data for the well, enabling better reservoir evaluations and appraisals.

BRIEF DESCRIPTION

Reference is now made to the following descriptions taken in conjunction with the accompanying drawings, in which.

Figure 1:
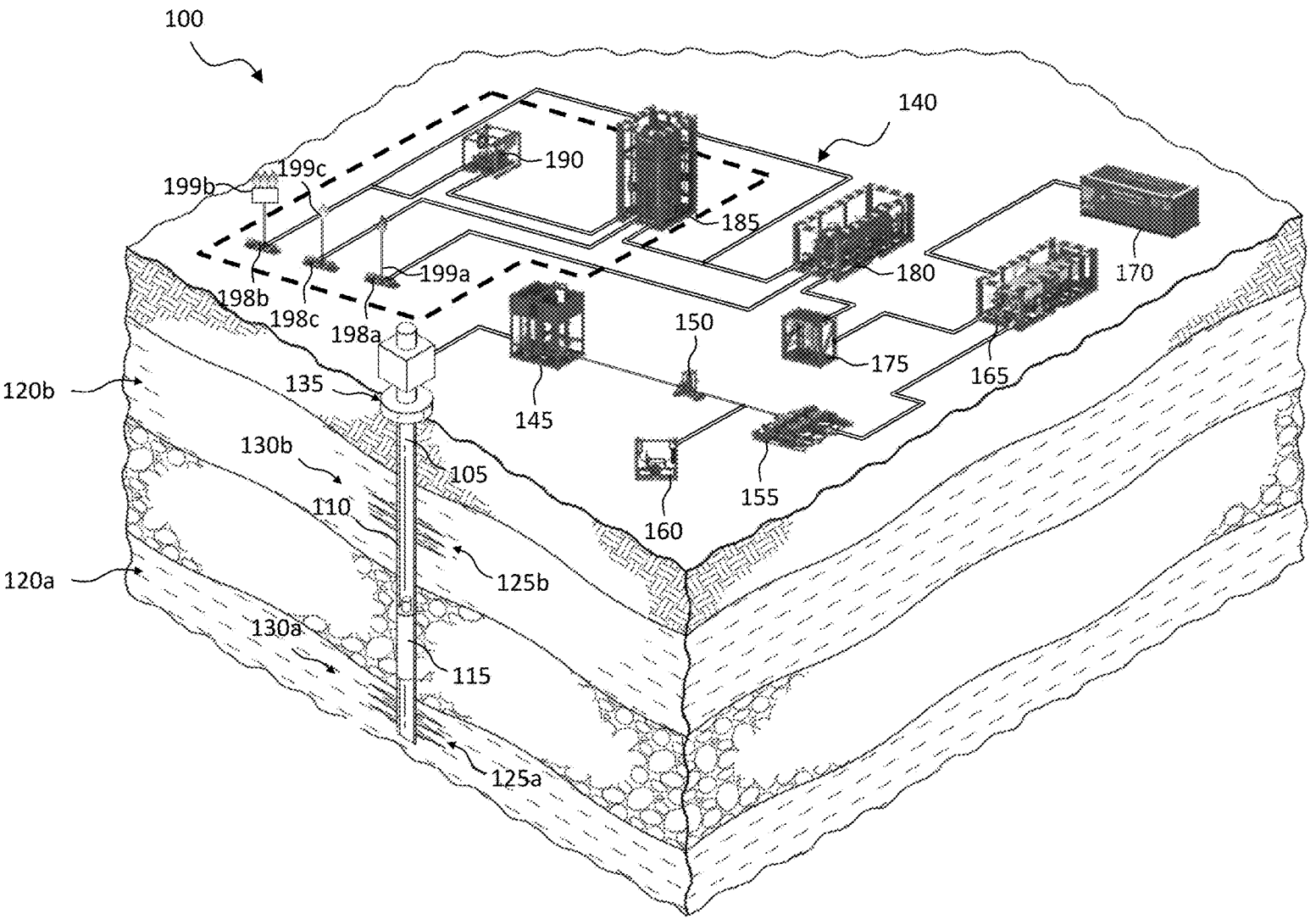
FIG. 1 illustrate a schematic, perspective view, with a portion in cross-section, of a well system, together with a flowback system designed, manufactured and/or operated according to one or more embodiments of the disclosure.
Figure 4A:
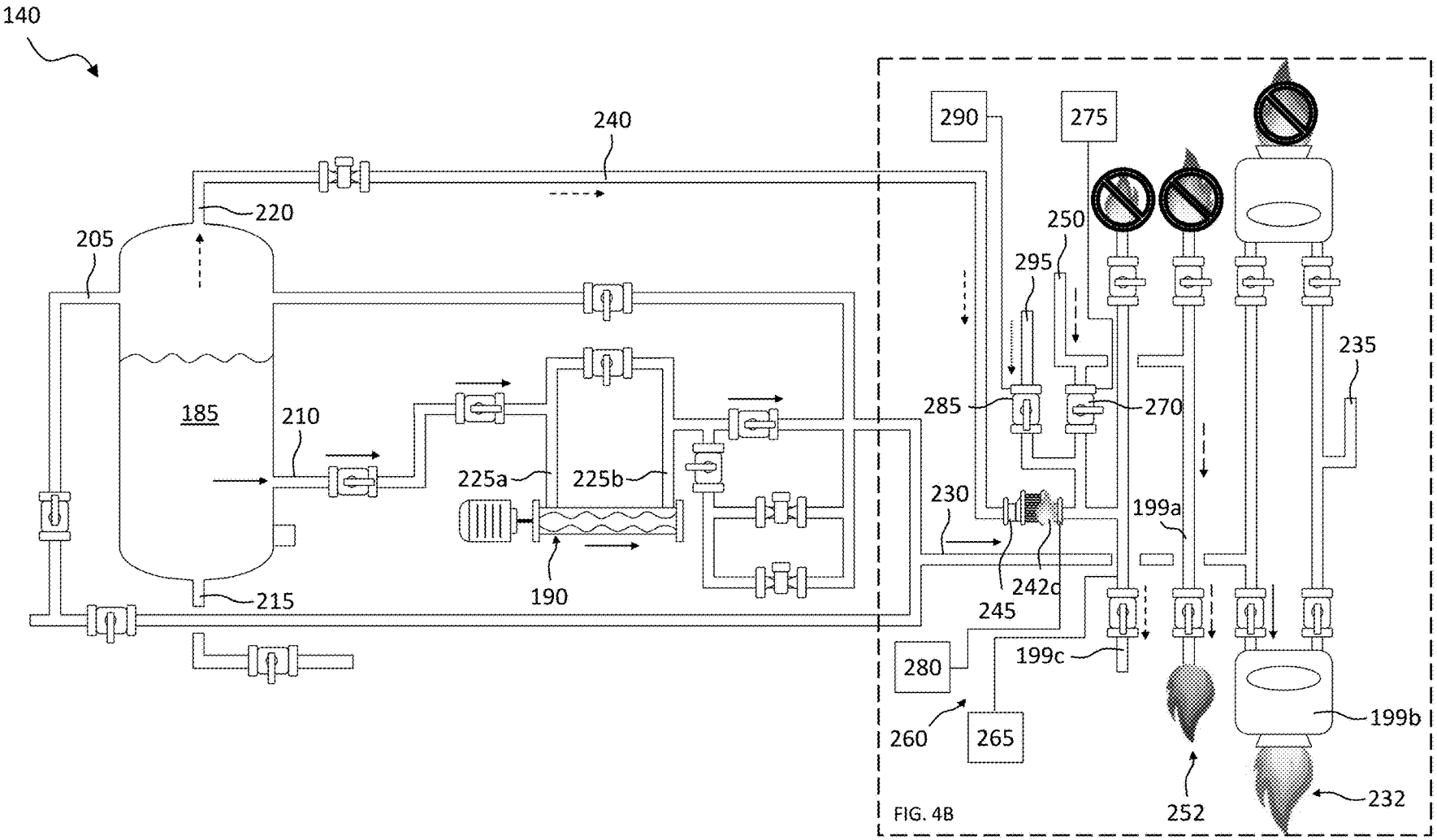
Figure 4B:
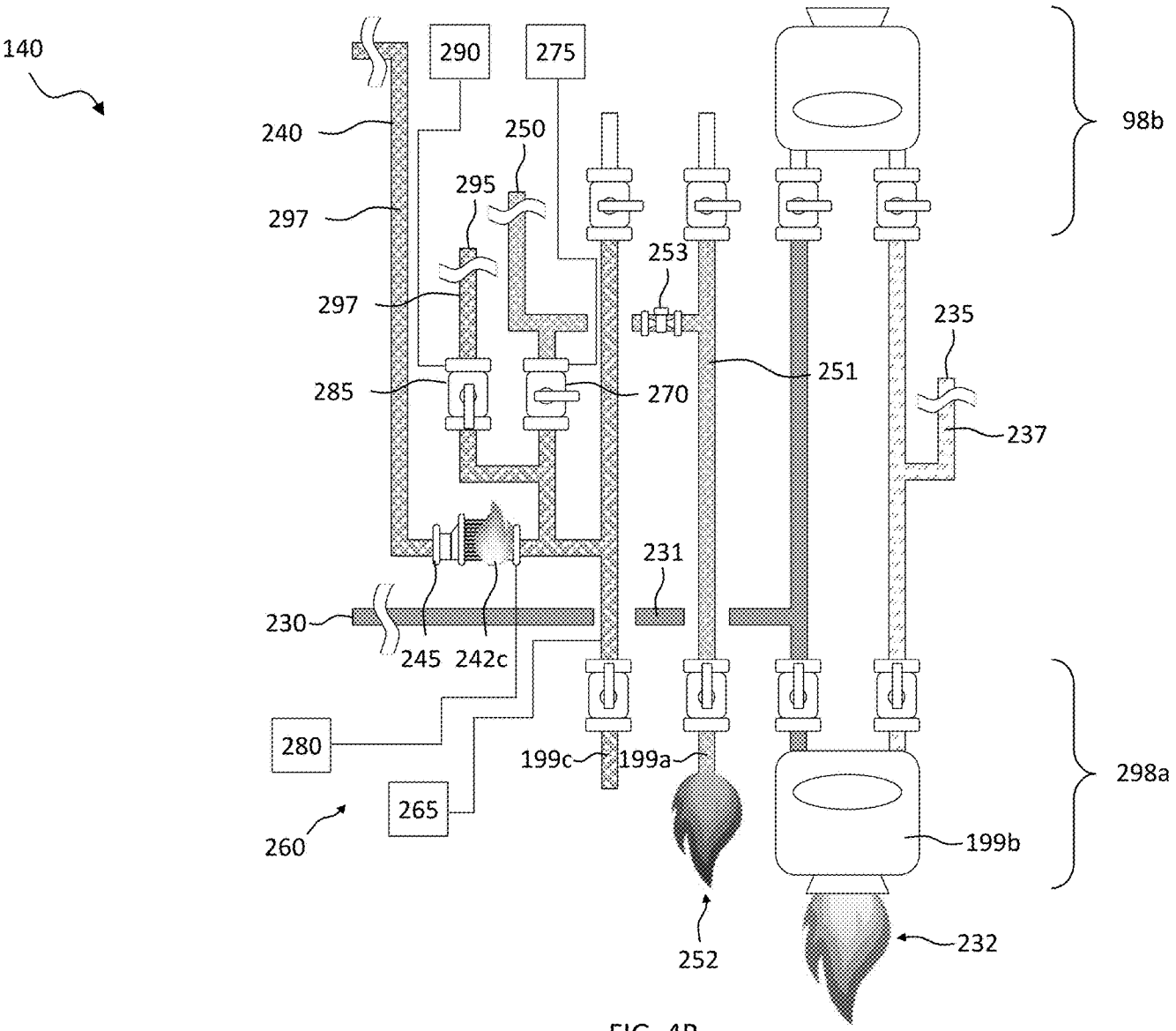
Figure 5A:
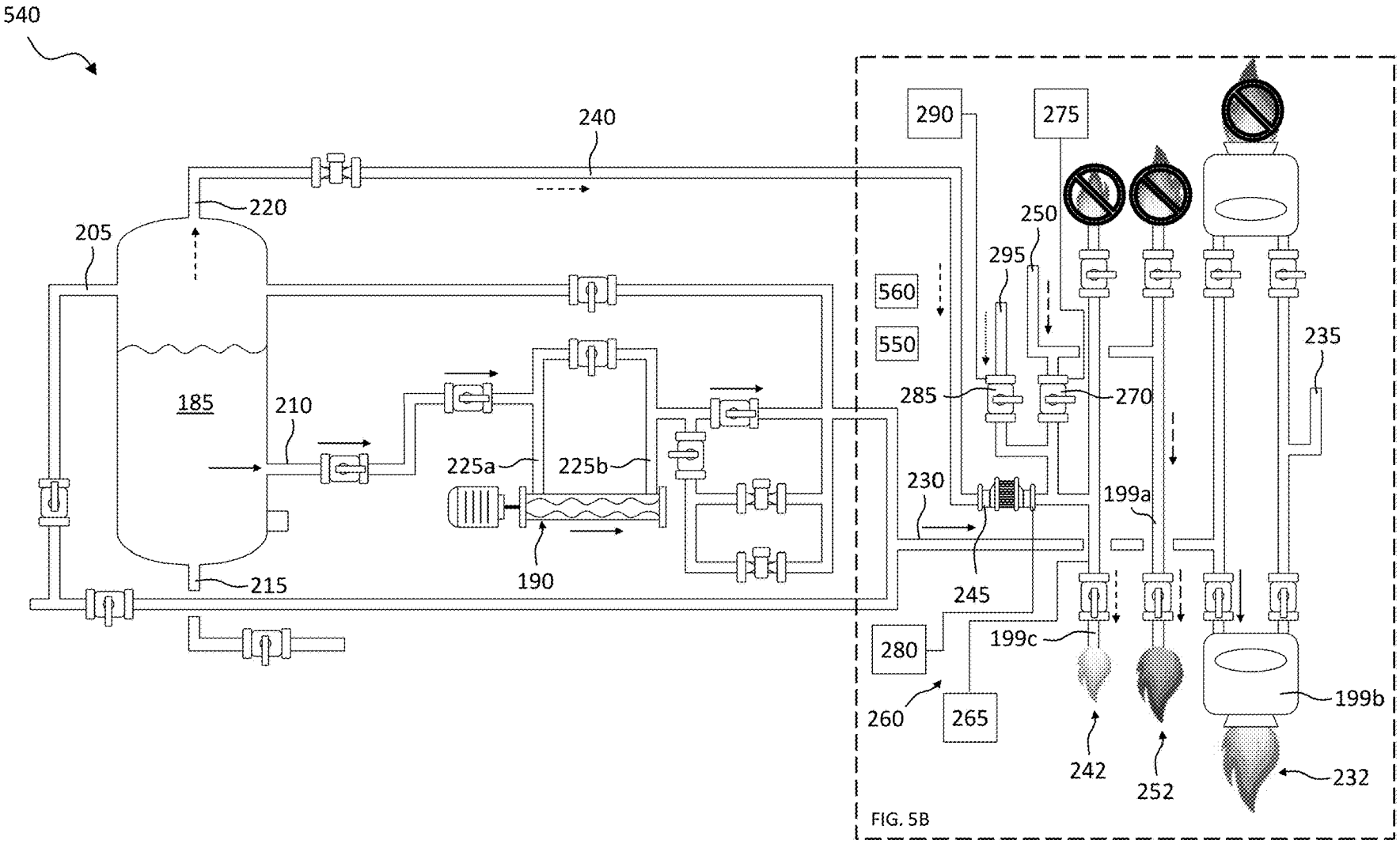
Figure 5B:
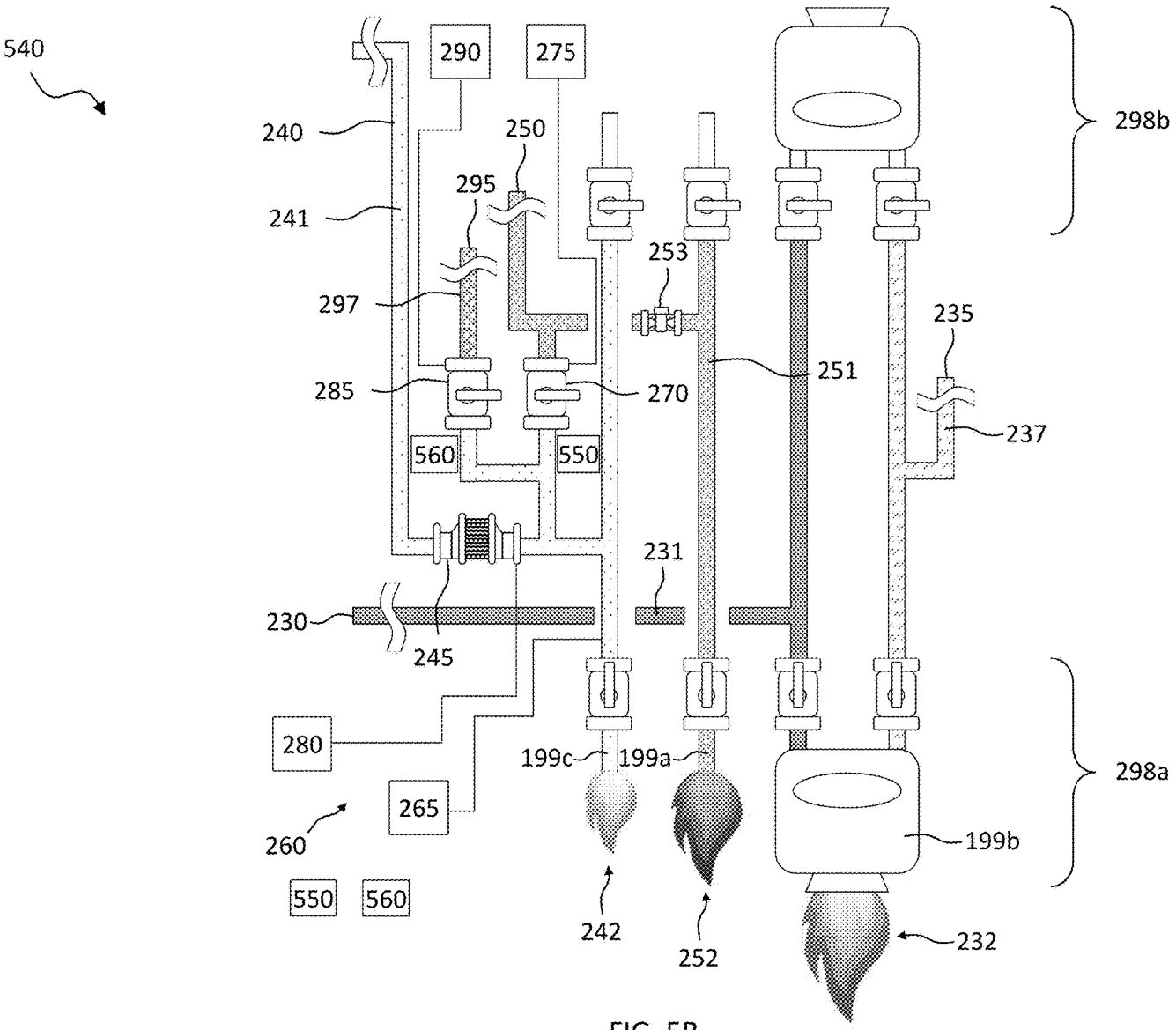

FIGS. 4A and 4B illustrate a zoomed in view of a portion of the flowback system of FIG. 1 after the control system senses a different unsafe system event and actuates a valve to supply inert gas from an inert gas line to a low-pressure vent line; and FIGS. 5A and 5B illustrate different views of an alternative embodiment of a flowback system designed, manufactured and operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein.

It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, or alternative toward the source of the fluid, regardless of the wellbore orientation; likewise, use of the terms "down," "lower," "downward," "downhole," "downstream" or other like terms shall be construed as generally toward the bottom, terminal end of a well, or alternative away from the source of the fluid, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The terms low-pressure and high-pressure, as used herein, are intended to be relative terms. Accordingly, a low-pressure is a pressure below a high-pressure, as well as a high-pressure is a pressure above a low-pressure, depending on which is the reference point. In at least one embodiment, a given low-pressure is at least 10 percent less than a given high-pressure. In yet another embodiment, a given low-pressure is at least 20 percent less than a given high-pressure, if not at least 50 percent less, or not at least 100 percent less for a vacuum condition (e.g., absolute pressure reference).

The terms low flowrate and high flowrate, as used herein, are intended to be relative terms. Accordingly, a low flowrate is a flowrate below a high flowrate, as well as a high flowrate is a flowrate above a low flowrate, depending on which is the reference point. In at least one embodiment, a given low flowrate is at least 10 percent less than a given flow rate. In yet another embodiment, a given low flowrate is at least 20 percent less than a given high flowrate, if not at least 50 percent less, or not at least 100 percent less for stagnation (e.g., no flow).

The present disclosure has acknowledged that today's flowback systems have certain drawbacks, many of which present safety hazards to those people standing and/or working in or around the flowback system. For example, the present disclosure has acknowledged that a tank (e.g., surge tank or atmospheric tank of a flowback system) may draw a vacuum when an associated transfer pump is activated to empty or otherwise draw from the tank (e.g., as a consequence of removing liquid volume from the tank). Unfortunately, as a low-pressure gas line (e.g., vent line) at the top of tank is often kept open to allow gas volume to enter the tank (e.g., preventing the tank from mechanical collapse), nearby flames from high-pressure gas lines and/or oil burners can be drawn back into the low-pressure gas line, thereby enabling combustion of gasses inside the low-pressure gas line and/or enabling a flame to travel back toward the tank itself. If either of the above situations were to occur, an explosion could occur, and the safety of those people standing in or around the flowback system could be jeopardized.

With these acknowledgments in mind, the present disclosure has developed an improved flowback system that seeks out unsafe system events, and when an unsafe system event is sensed takes remedial action (e.g., automatic remedial action) to prevent the combustion of gasses inside the low-pressure gas line and/or prevent the flame from travelling back toward the tank itself. In at least one embodiment, the improved flowback system employs a control system (e.g., a programmable logic controller) to seek out the unsafe system events and automatically take the remedial action (e.g., early detection and fast remedy to an unsafe system event (via automation) prior to catastrophic failure (explosion or tank collapse)—current operating methods often do not provide timely detection/remedy before catastrophic event has happened). For example, in at least one embodiment, the control system seeks out one or more of the following unsafe system events before automatically taking remedial action: 1) the activation of the transfer pump; 2) an undesirably low-pressure at the tip of the low-pressure gas line; 3) an undesirably low flowrate at the tip of the low-pressure gas line; 4) a flame entering the tip of the low-pressure gas line; 5) an undesirably high temperature at the flame arrester, indicative of a flame; 6) an undesirably high pressure at the flame arrester, indicative of a flame; 7) the existence of certain chemicals at the flame arrester, indicative of a flame; 8) a flame at the flame arrester; and 9) an undesirably high-pressure at the high-pressure gas line; 10) low pressure within the tank, among others.

Once the control system senses one or more of the above unsafe system events, the control system can actuate one or more valves, thereby remediating the unsafe system event. In at least one embodiment, at least one of the valves is coupled to a high-pressure fluid source, such that when opened the undesirably low-pressure or undesirably low flowrate at the tip of the low-pressure gas line is increased to an acceptable value that no longer allows the combustion of gasses inside the low-pressure gas line and/or the flame from travel back toward the tank itself. In accordance with one embodiment, the high-pressure fluid source is the high-pressure gaseous hydrocarbon flare line. Accordingly, gaseous hydrocarbons, already set for destruction (e.g., burning), are at least partially reharvested (e.g., reducing the emissions footprint) and redeployed to prevent oxygen ingress into the tip of the low-pressure gas line and/or tank, and thus remedy the unsafe system event.

When an undesirably high pressure is sensed at the high-pressure gas line, the undesirably high pressure may be reduced to an acceptable value by dumping excess gaseous hydrocarbons from the high-pressure gaseous hydrocarbon flare line into the low-pressure gas line. In doing so, the control system and one or more valves may ensure that no damage to equipment or upstream operations connected to the high-pressure gaseous hydrocarbon flare line occurs.

In yet another embodiment, at least one of the valves is coupled to an inert gas line (e.g., a gas line full of $N_2$, He, Ne, Ar, Kr, Xe, Rn, among others). Accordingly, the inert gas could replace any oxygen within the tip of the low-pressure gas line and/or tank, and thus mitigate the opportunity for flame combustion. In yet another embodiment, the inert gas line, which could be coupled to a downstream side of the flame arrester, could be used to quench a flame suspended at the flame arrester before the flame arrester element fails.

In yet another embodiment, the improved flowback system encompasses a fail-safe mechanism to ensure that the one or more valves may be actuated even if there is a loss of power to the control system and/or valves. In at least one embodiment, the fail-safe mechanism employs a sensor (e.g., thermoelectric sensor, pressure sensor, chemical sensor, etc.) that is triggered by a flame at the flame arrester. The sensor, in this embodiment, causes power either stored by a battery, or generated directly by the thermoelectric sensor, a pneumatic connection, or a chemical reaction to initialize and trigger the remediating event. Accordingly, the sensor could open the valve to the inert gas source, or optionally, open the valve to the high-pressure gas line. Once the unsafe system event has been eliminated (e.g., once the temperature, pressure or chemical species have returned to safe levels) the sensor could close the valve, returning the flowback system to normal operating conditions.

Turning now to FIG. 1, illustrated is a schematic, perspective view, with a portion in cross-section, of a well system 100, together with a flowback system 140 designed, manufactured and/or operated according to one or more embodiments of the disclosure. The well system 100, in one or more aspects, includes a wellbore 105 that includes a casing 110 that is cemented or otherwise secured to a wall of wellbore 105. While wellbore 105 is illustrated as including casing 110, other aspects can exist wherein wellbore 105 is a partially cased or includes no casing, e.g., an open hole wellbore. In at least one embodiment, a fracturing plug tool 115 is positioned in the wellbore 105 to isolate various subterranean formations (e.g., subterranean formation interval 120*a* and subterranean formation interval 120*b* in the illustrated embodiment.)

The well system 100 of FIG. 1 may additionally include fractures 125*a* or fractures 125*b* in the respective subterranean formation interval 120*a* or subterranean formation interval 120*b*. Fractures 125*a* or fractures 125*b* can increase formation porosity for increasing the fluid conductivity of respective flow path 130*a* and flow path 130*b* between the respective subterranean formation interval 120*a*, subterranean formation interval 120*b*, and wellbore 105. Perforations can be formed in the casing 110 to allow fracturing fluids or slurries to flow into subterranean formation interval 120*a* or subterranean formation interval 120*b*. The well system 100 may additionally include a wellhead tree 135 to cap wellbore 105.

The flowback system 140, in at least one embodiment, is configured to receive the flowback, and optionally use the collected flowback and any information obtained therefrom, to compile data for the well. As those skilled in the art may appreciate, a variety of different devices may be used to collect the flowback and obtain and compile the data. In the illustrated embodiment of FIG. 1, however, the flowback system 140 includes a sand management system 145. In the illustrated embodiment, an inlet of the sand management system 145 is coupled to the wellhead tree 135, and thus is configured to receive the flowback directly from the wellbore 105. The flowback system 140 of the embodiment of FIG. 1, may additionally include a choke manifold 155. In the illustrated embodiment, an inlet of the choke manifold 155 is coupled to an outlet of the sand management system 145. In at least one embodiment, a safety valve 150 is coupled between the sand management system 145 and the choke manifold 155. Furthermore, in at least one embodiment, an outlet of a chemical injection pump 160 may optionally T-into a line between the safety valve 150 and the choke manifold 155.

The flowback system 140 of FIG. 1 may additionally include a steam heat exchanger 165 coupled to an outlet of the choke manifold 155, as well as a boiler 170 coupled to an outlet of the steam heat exchanger 165. Furthermore, the flowback system 140 may additionally include a multi-phase flow meter 175 coupled to another outlet of the steam heat exchanger 165, as well as a separator 180 coupled to an outlet of the multi-phase flow meter 175. As those skilled in the art may appreciate, the separator 180 may take multi-phase fluid flow from its inlet and separate each fluid phase into independent piping outlets (e.g., oil, gas, water, solids). In at least one embodiment, a first outlet of the separator 180 may be coupled to an inlet of a tank 185 (e.g., fluid tank such as an oil surge tank). Typically, the first outlet of the separator 180 is providing primarily low-pressure hydrocarbons and fracturing fluid to the tank 185. Nevertheless, in certain situations the low-pressure hydrocarbons bypass the tank 185. In at least one other embodiment, a second outlet of the separator 180 may be coupled to a first diverter manifold 198*a* and flare tip 199*a* for burning, as shown. Typically, the second outlet of the separator 180 is providing primarily high-pressure gaseous hydrocarbons (e.g., high pressure natural gas) to the first diverter manifold 198*a*.

In the illustrated embodiment of FIG. 1, a first outlet of the tank 185 may be coupled to the inlet of a transfer pump 190. The transfer pump 190, in this embodiment, is configured to pull any liquid hydrocarbons from the tank 185, and send them to a second diverter manifold 198*b* and burner head 199*b* for burning, as shown. In at least one other embodiment, a second outlet of the tank 185 may be coupled to a third diverter manifold 198*c* and flare tip 199*c* for burning, as shown. Typically, the second outlet of the tank 185 is providing primarily low-pressure gaseous hydrocarbons (e.g., low pressure natural gas) to the third diverter manifold 198*c*, as might be collected in the top of the tank 185. In at least one embodiment, it is the low-pressure gaseous hydrocarbons, third diverter manifold 198*c* and flare tip 199*c* that the present disclosure is concerned about drawing the flame back into the tank 185.

Figure 2A:
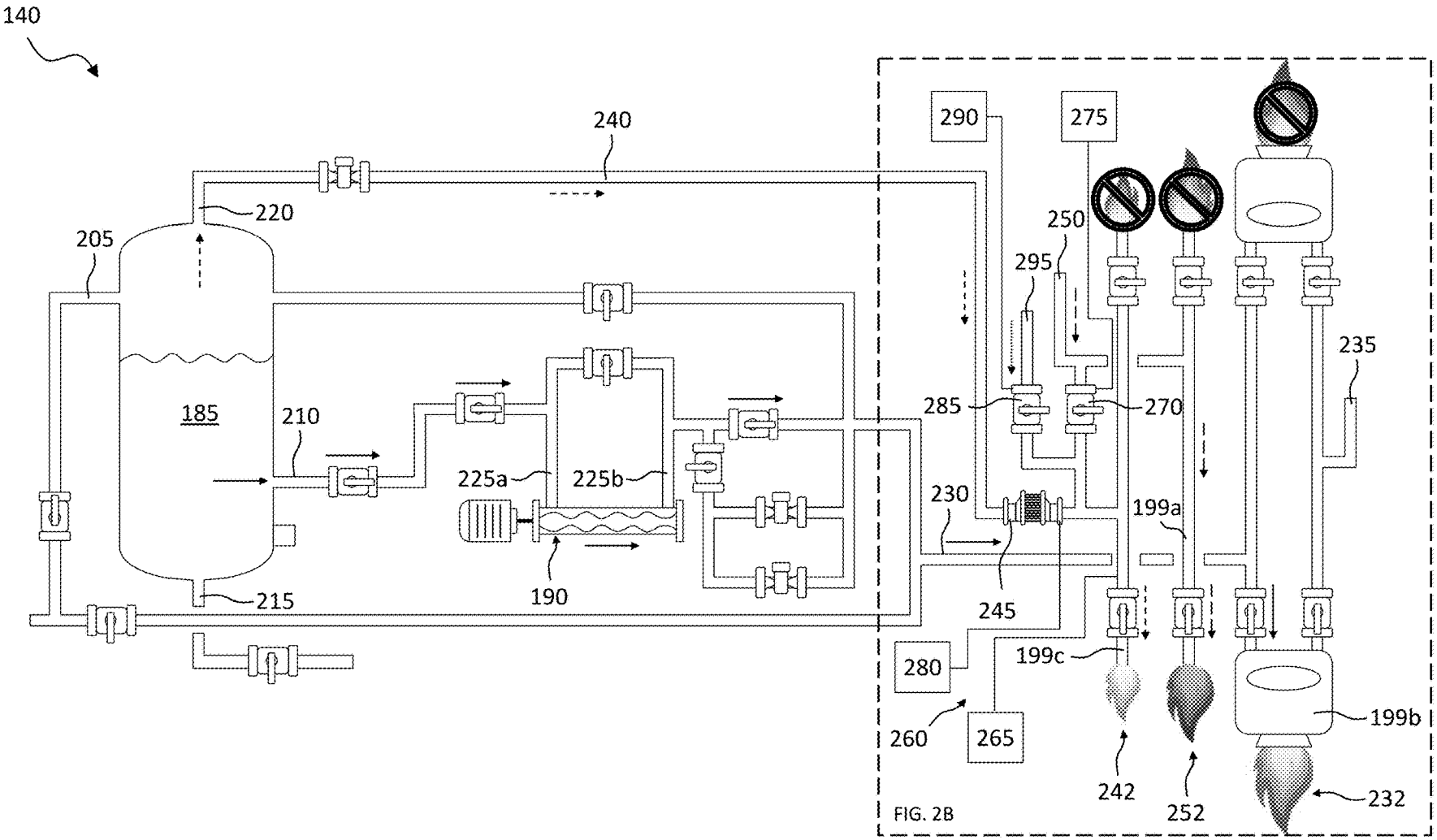
FIGS. 2A and 2B illustrate a zoomed in view of a portion of the flowback system of FIG. 1 during normal operational conditions.
Figure 2B:
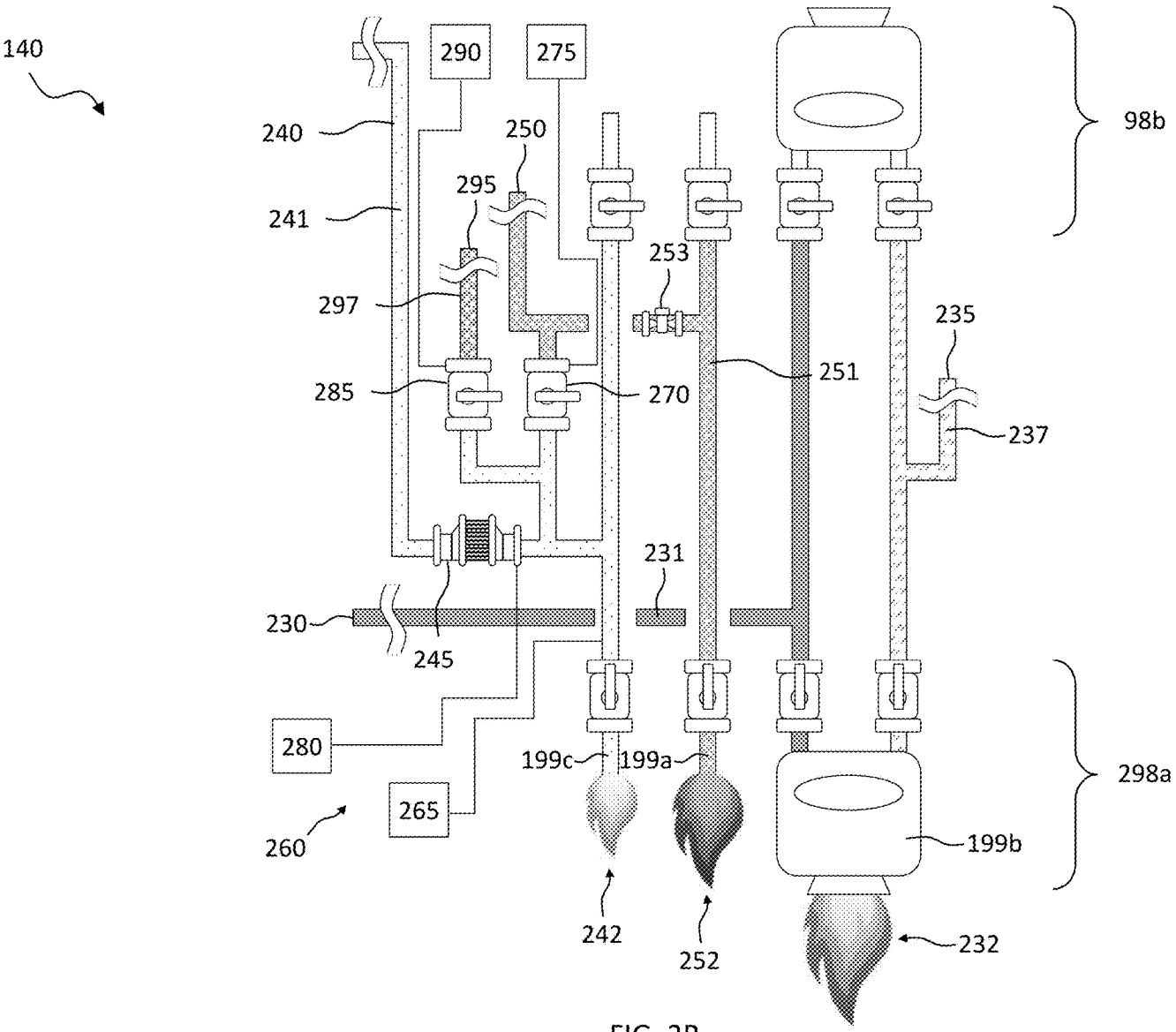

Turning to FIGS. 2A and 2B, with continued reference to FIG. 1, illustrated is a zoomed in view of a portion of the dotted line section of the flowback system 140 of FIG. 1. In the illustrated embodiment of FIG. 2A, the flowback system 140 includes the tank 185. As shown, the tank 185 may be a liquid hydrocarbon (e.g., oil) based tank. The tank 185, in the illustrated embodiment, includes an inlet 205, a first fluid outlet 210, an optional second fluid outlet 215, and a vent 220. The fluid inlet 205, in at least one embodiment, may be coupled to the wellhead tree 135, for example by way of one or more devices including the choke manifold 155 and the separator 180. Accordingly, the fluid inlet 205 may be used to insert liquids and/or gasses (e.g., liquid and gaseous hydrocarbons) and potentially other fluids (e.g., fracturing fluid, water, etc.) within the tank 185.

The first fluid outlet 210, in the illustrated embodiment, is coupled to the transfer pump 190. Accordingly, the first fluid outlet 210 and the transfer pump 190 may be used to withdraw liquid hydrocarbons from the tank 185. In the illustrated embodiment, the first fluid outlet 210 couples with a transfer pump inlet 225*a*, and then a transfer pump outlet 225*b* supplies the liquid hydrocarbons via a liquid hydrocarbon line 230 to the burner head 199*b* for burning via a flame 232, as is shown. In at least one embodiment, an accelerant, such as compressed air, is added at injection point 235 to increase the effectiveness of the burn.

The optional second fluid outlet 215, in the illustrated embodiment, is positioned proximate a bottom of the tank 185, and thus may be used to remove heavier fluids, such as water, diesel, solids, etc. from the tank 185. Accordingly, the optional second fluid outlet 215 may be used to transfer the heavier fluids such as water to a treatment plant, among other desirable locations.

The vent 220, in the illustrated embodiment, is positioned to allow gasses (e.g., gaseous hydrocarbons, air, etc.) to exit the tank 185 when the tank 185 is under a positive pressure, or gasses (e.g., gaseous hydrocarbons, air, inert gas, etc.) to enter the tank 185 when the tank 185 is under a vacuum. The vent 220, in the illustrated embodiment, is coupled to a low-pressure vent line 240. The low-pressure vent line 240, in the illustrated embodiment, may be coupled to an optional diverter manifold, and flare tip 199*c*, for burning of the low-pressure gaseous hydrocarbons via a flame 242, as is shown. Furthermore, in at least one embodiment, a flame arrester 245 may be positioned in-line with the low-pressure vent line 240 between the vent 220 and the flare tip 199*c*.

The flowback system 140, in at least one embodiment, additionally includes a high-pressure gaseous hydrocarbon line 250. The high-pressure gaseous hydrocarbon line 250, in at least one embodiment, might be coupled directly to the separator 180. The high pressure gaseous hydrocarbon line 250, in the illustrated embodiment, may also be coupled to an optional diverter manifold, and flare tip 199*a*, for burning of the high-pressure gaseous hydrocarbons via a flame 252, as is shown. As is further shown, the flowback system 140 may include a plurality of different appropriately placed valves (e.g., manual or non-autonomous valves) to open and/or close each of the various lines therein.

As indicated above, various unsafe system events may occur, for example causing the flame 242 to extinguish for one or more different reasons, thereby allowing the flame 232 or 252 to be drawn into the flare tip 199*c*. For example, by turning on the transfer pump 190, a vacuum could be drawn in an upper portion of the tank 185, and thus the low-pressure vent line 240, which could result in the flame 232 or 252 and any surrounding oxygen to be drawn back into the flare tip 199*c*, thereby providing all the requisites for combustion within the flare tip 199*c*. Moreover, depending on how far back the flame travels, the combustion could occur in the low-pressure vent line 240, or even the tank 185. Similarly, an undesirably low-pressure at the flare tip 199*c*, or an undesirably low flowrate at the flare tip 199*c*, might allow surrounding oxygen and/or the flame 232 or 252 to travel back into the flare tip 199*c*.

The term undesirably low-pressure, as that term is used herein, is a pressure that is insufficient to keep the flame 242 exiting the flare tip 199*c*. In at least one embodiment, the undesirably low-pressure is a pressure that is at least 5 percent above a pressure insufficient to keep the flame 242 exiting the flare tip 199*c*, if not at least 10 percent above the pressure insufficient to keep the flame 242 exiting the flare tip 199*c*, if not 25 percent above the pressure insufficient to keep the flame 242 exiting the flare tip 199*c*. In yet another embodiment, the undesirably low-pressure is a pressure of at least 101 KPa.

The term undesirably low flowrate, as that term is used herein, is a flowrate that is insufficient to keep the flame 242 exiting the flare tip 199*c*. In at least one embodiment, the undesirably low flowrate is a flowrate that is at least 5 percent above a flowrate insufficient to keep the flame 242 exiting the flare tip 199*c*, if not at least 10 percent above the flowrate insufficient to keep the flame 242 exiting the flare tip 199*c*, if not at least 25 percent above the flowrate insufficient to keep the flame 242 exiting the flare tip 199*c*. In yet another embodiment, the undesirably low flowrate less than a minimum purge sweep gas velocity necessary to prevent stagnation of at least 0.2 scfm.

To address these as well as other safety concerns, the flowback system 140 may additionally include a control system 260 designed, manufactured and operated according to one or more embodiments of the disclosure. The control system 260, in at least one embodiment, may include a sensor 265, a valve 270 and a valve controller 275 coupled to the valve 270. In accordance with one embodiment, the valve 270 of the control system 260 is coupled between the low-pressure vent line 240 and the high-pressure gaseous hydrocarbon line 250. Thus, in accordance with one embodiment, the control system 260 is configured to sense an unsafe system event in the flowback system 140 and actuate the valve 270 to supply high-pressure gaseous hydrocarbons from the high-pressure gaseous hydrocarbon line 250 to the low-pressure vent line 240. In at least one embodiment, the control system 260 is configured to sense the unsafe system event and automatically actuate the valve 270 using the valve controller 275.

The valve 270 may be any type of valve and remain within the scope of the disclosure. For instance, in at least one embodiment, the valve 270 is a ball-type valve. Moreover, in at least on embodiment, the valve 270 couples with the low-pressure vent line 240 downstream of the flame arrester 245.

The unsafe system events may vary greatly and remain within the scope of the disclosure. For instance, in at least one embodiment, the sensor 265 may sense a fire proximate a downstream end of the flame arrester 245, which causes the valve controller 275 to actuate (e.g., open) the valve 270 to supply high-pressure gaseous hydrocarbons from the high-pressure gaseous hydrocarbon line 250 to the low-pressure vent line 240. In another embodiment, the sensor 265 may sense an activation of the transfer pump 190, which causes the valve controller 275 to actuate (e.g., open) the valve 270 to supply high-pressure gaseous hydrocarbons from the high-pressure gaseous hydrocarbon line 250 to the low-pressure vent line 240. In yet another embodiment, the sensor 265 may sense an undesirably low pressure at the first flare tip 199*c*, which causes the valve controller 275 to actuate (e.g., open) the valve 270 to supply high-pressure gaseous hydrocarbons from the high-pressure gaseous hydrocarbon line 250 to the low-pressure vent line 240. In even yet another embodiment, the sensor 265 may sense an undesirably low flowrate at the first flare tip 199*c*, which causes the valve controller 275 to actuate (e.g., open) the valve 270 to supply high-pressure gaseous hydrocarbons from the high-pressure gaseous hydrocarbon line 250 to the low-pressure vent line 240. In one other embodiment, the sensor 265 may sense an undesirably high pressure at the high-pressure gaseous hydrocarbon line 250, which causes the valve controller 275 to actuate (e.g., open) the valve 270 to supply high-pressure gaseous hydrocarbons from the high-pressure gaseous hydrocarbon line 250 to the low-pressure vent line 240, for example releasing pressure from the high-pressure gaseous hydrocarbon line 250. While specific examples of unsafe system events have been listed, others are within the scope of the disclosure. Additionally, the sensor 265 may be capable of sensing more than one of the unsafe system events, and thus cause the valve controller 275 to actuate (e.g., open) the valve 270 to supply high-pressure gaseous hydrocarbons from the high-pressure gaseous hydrocarbon line 250 to the low-pressure vent line 240 when sensing any of the unsafe system events.

The control system 260, in at least one other embodiment, might include a second sensor 280, a second valve 285 coupled between an inert gas line 295 and the low-pressure vent line 240, and a second valve controller 290 coupled to the second valve 285. In such an embodiment, the control system 260 could sense one or more different unsafe system events and automatically actuate the second valve 285 to supply inert gas from the inert gas line 295 to the low-pressure vent line 240.

The second valve 285 may be any type of valve and remain within the scope of the disclosure. For instance, in at least one embodiment, the second valve 285 is a ball-type valve. Moreover, in at least on embodiment, the second valve 285 couples with the low-pressure vent line 240 downstream of the flame arrester 245.

The different unsafe system events may vary greatly and remain within the scope of the disclosure. For instance, in at least one embodiment, the second sensor 280 may sense a fire proximate a downstream end of the flame arrester 245, which causes the second valve controller 290 to actuate (e.g., open) the second valve 285 to supply inert gas from the inert gas line 295 to the low-pressure vent line 240. In another embodiment, the second sensor 280 may sense an increase in temperature proximate a downstream end of the flame arrester 245, which causes the second valve controller 290 to actuate (e.g., open) the second valve 285 to supply inert gas from the inert gas line 295 to the low-pressure vent line 240. In yet another embodiment, the second sensor 280 may sense an increase in pressure proximate a downstream end of the flame arrester 245, which causes the second valve controller 290 to actuate (e.g., open) the second valve 285 to supply inert gas from the inert gas line 295 to the low-pressure vent line 240. In yet even another embodiment, the second sensor 280 may sense a change in chemical composition proximate a downstream end of the flame arrester 245, which causes the second valve controller 290 to actuate (e.g., open) the second valve 285 to supply inert gas from the inert gas line 295 to the low-pressure vent line 240.

While specific examples of different unsafe system events have been listed, others are within the scope of the disclosure. Additionally, the second sensor 280 may be capable of sensing more than one of the different unsafe system events, and thus cause the second valve controller 290 to actuate (e.g., open) the second valve 285 to supply inert gas from the inert gas line 295 to the low-pressure vent line 240 when sensing any of the different unsafe system events.

The sensor 265, valve 270, and valve controller 275 are particularly useful in preventing a combustion situation wherein one of the flames 232, 242, 252 is drawn back within the flare tip 199*c*. In contrast, the second sensor 280, second valve 285 and second valve controller 290 are particularly useful in ending a combustion situation wherein one of the flames 232, 242, 252 has already been drawn back within the flare tip 199*c*, and particularly a situation wherein one of the flames 232, 242, 252 has reached the flame arrester 245. Accordingly, one or more embodiments exist wherein the two are operated in tandem.

The locations of the sensor 265 and/or sensor 280 may vary greatly and remain within the scope of the present disclosure. In fact, the sensor 265 and/or sensor 280 may be positioned at any location within the flowback system 140 where an unsafe system event may be detected. Thus, while the sensor 265 is illustrated as positioned proximate the flare tip 199*c*, and sensor 280 is illustrated as positioned proximate the downstream side of the flame arrester 245, the present disclosure is not so limited.

In at least one embodiment, valve 270 would remain closed until certain conditions exist: indication that there is sufficiently high flow or pressure at HP gas line at the diverter manifold (to supply LP Gas Line), temperature data at the flame arrester indicating no flame is present, indication that the transfer pump is running (e.g., via the physical digital I/O "switch" status or flow rate discharge data—from inline flow meter), dropping pressure (or onset of vacuum) indication at the tank and/or dropping liquid level measurement at the tank. Combined, these sensor outputs enable safe opening of valve 270, ensuring the harvest gas will naturally flow to the tank and refill the tank volume being expelled via the transfer pump 190. If at any point any one of the above conditions are violated (e.g., not true), then valve 270 could be automatically programmed to close.

Turning now to FIG. 2B, illustrated is a zoomed in view of the dotted line section of FIG. 2A, which includes at least a portion of the flowback system 140 and the control system 260. While not discussed with regard to FIG. 2A, the flowback system 140 may include a first burner region 298*a*, which may include the diverter manifolds 198*a*, 198*b*, 198*c* and the flare tips 199*a*, 199*c* and burner head 199*c*. The flowback system 140 may additionally include a second burner region 298*b*, which may include associated diverter manifolds, flare tips, and burner heads. In at least one embodiment, the first and second burner regions 298*a*, 298*b* are operated out of phase, such that when one is operational (e.g., the first burner region 298*a* is operational in FIGS. 2A and 2B) the other is not operational. As shown, various valves may be used to control which burner region 298*a*, 298*b* is operational in a given moment.

FIGS. 2A and 2B illustrate the flowback system 140 in normal operation, for example wherein the control system 260 has yet to sense an unsafe system event or different unsafe system event, as described above. Accordingly, as clearly shown in FIG. 2B, the liquid hydrocarbon line 230 is full of liquid hydrocarbons 231 that are being supplied to the burner head 199*b* and creating a flame 232, and in certain embodiments the injection point 235 is full of an accelerant 237 such as compressed air. Similarly, the low-pressure vent line 240 is full of low-pressure gaseous hydrocarbons 241 that are being supplied to the flare tip 199*c* and creating a flame 242. Likewise, the high-pressure gaseous hydrocarbon line 250 is full of high-pressure gaseous hydrocarbons 251 that are being supplied to the flare tip 199*a* and creating a flame 252. Moreover, in certain embodiments the inert gas line 295 is full of inert gas 297, but the second valve 285 is closed, thereby preventing the inert gas 297 from being supplied to the low-pressure vent line 240.

Figure 3A:
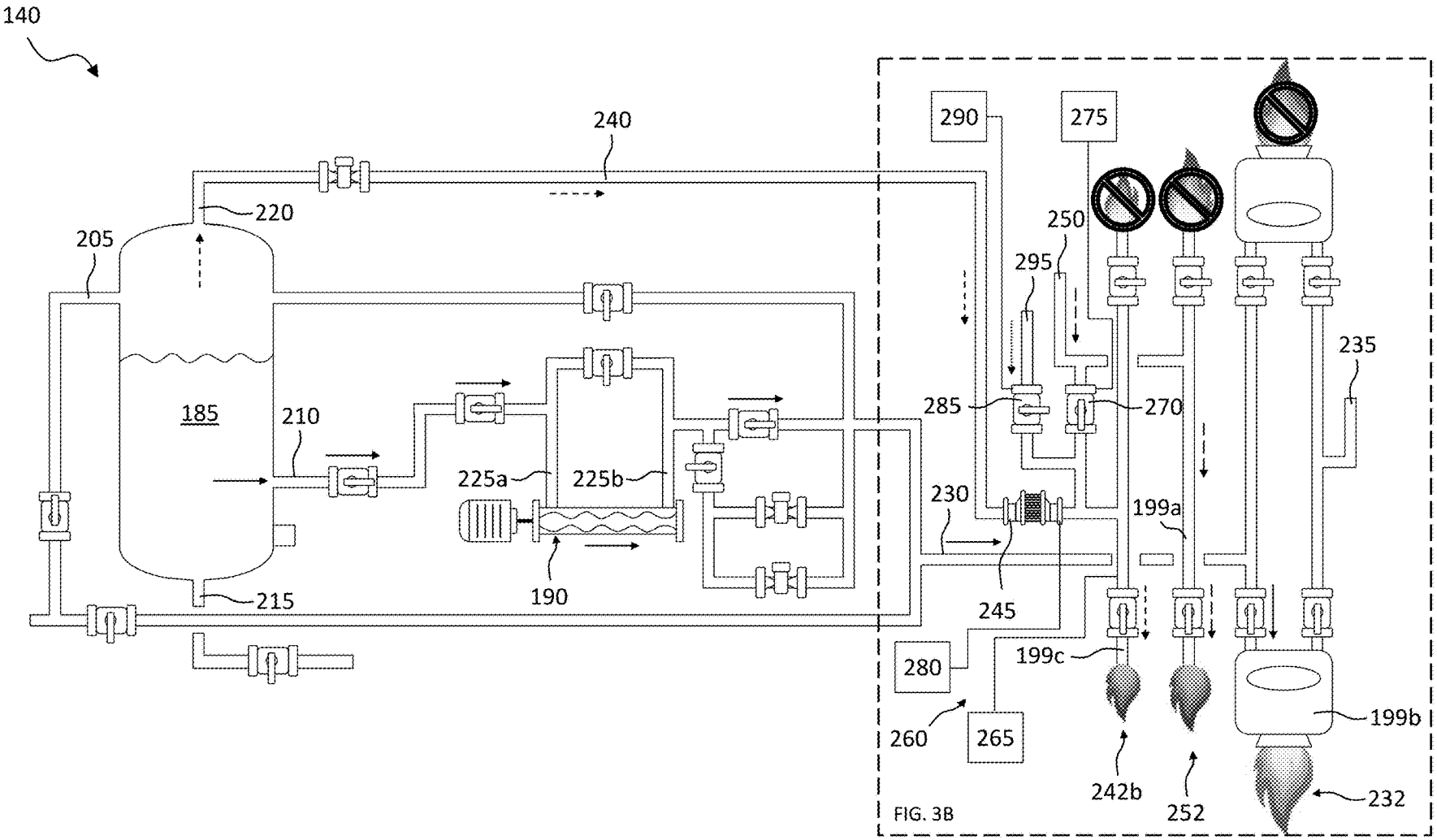
FIGS. 3A and 3B illustrate a zoomed in view of a portion of the flowback system of FIG. 1 after the control system senses an unsafe system event and actuates a valve to supply high-pressure gaseous hydrocarbons from a high-pressure gaseous hydrocarbon line to a low-pressure vent line.
Figure 3B:
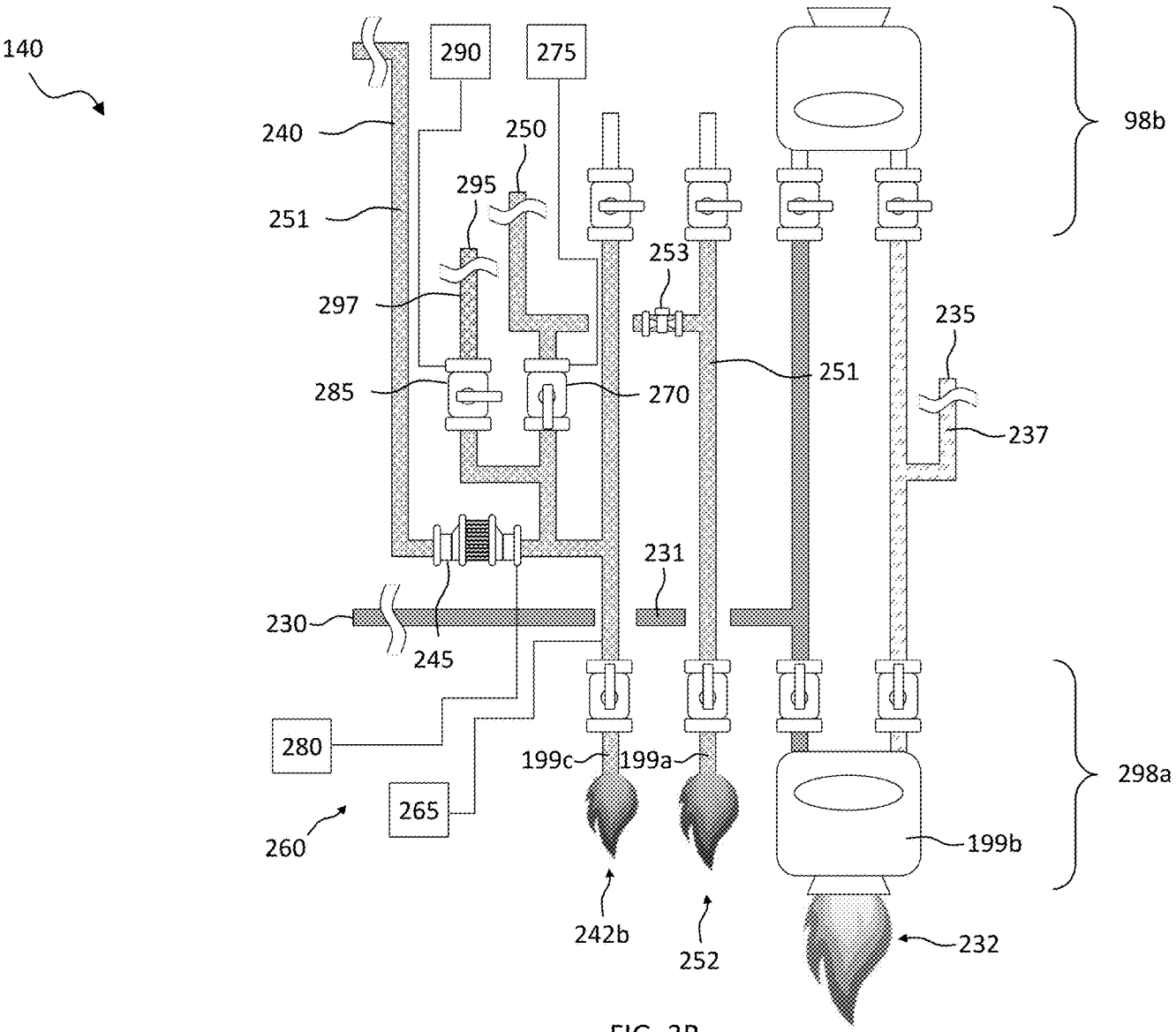

Turning now to FIGS. 3A and 3B, illustrated is a zoomed in view of a portion of the flowback system 140 after an unsafe system event has been sensed by the control system 260. For example, the control system 260 may have sensed, among others, one or more of the following: a fire proximate a downstream end of the flame arrester 245; an activation of the transfer pump 190; an undesirably low pressure at the first flare tip 199*c*; an undesirably low pressure at the surge tank vent 220; an undesirably low flowrate at the first flare tip 199*c*; and an undesirably high pressure at the high-pressure gaseous hydrocarbon line 250, among others. In this embodiment, having sensed the unsafe system event, the control system 260 has actuated the valve 270 to supply the high-pressure gaseous hydrocarbons 251 from the high-pressure gaseous hydrocarbon line 250 to the low-pressure vent line 240.

Accordingly, as clearly shown in FIG. 3B, the liquid hydrocarbon line 230 is full of liquid hydrocarbons 231 that are being supplied to the burner head 199*b* and creating a flame 232, and in certain embodiments the injection point 235 is full of an accelerant 237 such as compressed air. Similarly, the low-pressure vent line 240 is full of high-pressure gaseous hydrocarbons 251 that are being supplied to the flare tip 199*c* and creating a flame 242*b*. In at least one embodiment, a flow control device 253 is employed to increase the fluid pressure on the upstream side of the flow control device 253, and thus in the low pressure vent line 240, when the valve 270 is open. The flow control device 253 may comprise many different devices and remain within the scope of the disclosure. Nevertheless, in at least one embodiment, the flow control device 253 is another valve (e.g., actuatable valve), a restrictor, a choke, or another device capable of keeping the pressure in the low pressure vent line 240 above a predetermined value when the valve 270 is open. Likewise, the high-pressure gaseous hydrocarbon line 250 is full of high-pressure gaseous hydrocarbons 251 that are being supplied to the flare tip 199*a* and creating a flame 252. Moreover, in certain embodiments the inert gas line 295 is full of inert gas 297, but the second valve 285 is closed, thereby preventing the inert gas 297 from being supplied to the low-pressure vent line 240.

Turning now to FIGS. 4A and 4B, illustrated is a zoomed in view of a portion of the flowback system 140 after a different unsafe system event has been sensed by the control system 260. For example, the control system 260 may have sensed, among others, one or more of the following: a fire proximate a downstream end of the flame arrester 245; an increase in temperature proximate a downstream end of the flame arrester 245; a change in pressure proximate a downstream end of the flame arrester 245 (e.g., an increase in pressure if there is a fire, but a decrease in pressure if the flow rate in the low-pressure vent line 240 decreases); and a change in chemical composition (e.g., the constituents of a fire, water, etc.) proximate a downstream end of the flame arrester 245. In this embodiment, having sensed the different unsafe system event, the control system 260 has actuated the second valve 285 to supply the inert gas 297 from the inert gas line 295 to the low-pressure vent line 240, for example to extinguish the flame 242*c*.

Accordingly, as clearly shown in FIG. 4B, the liquid hydrocarbon line 230 is full of liquid hydrocarbons 231 that are being supplied to the burner head 199*b* and creating a flame 232, and in certain embodiments the injection point 235 is full of an accelerant 237 such as compressed air. Similarly, the low-pressure vent line 240 is full of inert gas 297 that is being supplied to the low-pressure vent line 240, and more particularly in the embodiment of FIG. 4B supplied a downstream end of the flame arrester 245. The opening of valve 285 in this embodiment supplies a higher pressure inert gas to all low pressure lines, which serves as a safeguard to ensure oxygen is purged from these lines; preventing combustible mixture from entering the system, flame suction, and tank vacuum (collapse) while pumping. Such an operational scenario is especially valuable in the event that the supply of high-pressure gaseous hydrocarbons 251 is limited (e.g., a high liquid producing well with low gas production), thereby preventing insufficient gas supply to re-harvest to the low-pressure vent line 240. Likewise, the high-pressure gaseous hydrocarbon line 250 is full of high-pressure gaseous hydrocarbons 251 that are being supplied to the flare tip 199*a* and creating a flame 252.

In at least one embodiment, regardless of whether the control system 260 senses the unsafe system event first or the different unsafe system event first, or alternatively senses both the unsafe system event and the different unsafe system event, the control system 260 may return the flowback system 140 to the normal operation state illustrated in FIGS. 2A and 2B once the unsafe system event or the different unsafe system event is no longer of concern. For example, the control system 260 may return the valve 270 and/or second valve 285 to their respective closed states once the unsafe system event or the different unsafe system event is no longer of concern.

Turning now to FIGS. 5A and 5B, illustrated are different views of an alternative embodiment of a flowback system 540 designed, manufactured and operated according to one or more embodiments of the disclosure. The flowback system 540 of FIGS. 5A and 5B is similar in many respects to the flowback system 140 of FIGS. 2A and 2B. Accordingly, like reference numbers have been used to indicate similar, if not identical, features. The flowback system 540 differs, for the most part, from the flowback system 140, in that the flowback system 540 includes a battery backup 550 and/or self-powered actuating circuit 560 that is configured to power at least a portion of the control system 260 if power is lost. Thus, even if there is a loss of power to the control system 260, the battery backup 550 and/or self-powered actuating circuit 560 may power the control system 260, and thus still address the unsafe system event or different unsafe system event as discussed above. In at least one embodiment, the self-powered actuating circuit 560 is a thermoelectric circuit that is configured to actuate the valve 270 or second valve 285 when encountering a high temperature event. Nevertheless, other self-powered actuating circuits 560 are within the scope of the present disclosure.

Aspects disclosed herein include:

A. A flowback system, the flowback system including: 1) a tank, the tank including an inlet, a fluid outlet, and a vent; 2) a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank; 3) a low-pressure vent line coupled between the vent and a first flare tip, the first flare tip configured to burn low-pressure gaseous hydrocarbons received from the tank; 4) a high-pressure gaseous hydrocarbon line coupled to a second flare tip, the second flare tip configured to burn high-pressure gaseous hydrocarbons; and 5) a control system including a sensor, a valve and a valve controller coupled to the valve, the valve of the control system coupled between the low-pressure vent line and the high-pressure gaseous hydrocarbon line, the control system configured to sense an unsafe system event and actuate the valve to supply high-pressure gaseous hydrocarbons from the high-pressure gaseous hydrocarbon line to the low-pressure vent line.

B. A method, the method including: 1) providing a flowback system, the flowback system including: a) a tank, the tank including an inlet, a fluid outlet, and a vent; b) a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank; c) a low-pressure vent line coupled between the vent and a first flare tip, the first flare tip configured to burn low-pressure gaseous hydrocarbons received from the tank; d) a high-pressure gaseous hydrocarbon line coupled to a second flare tip, the second flare tip configured to burn high-pressure gaseous hydrocarbons; and e) a control system including a sensor, a valve and a valve controller coupled to the valve, the valve of the control system coupled between the low-pressure vent line and the high-pressure gaseous hydrocarbon line; and 2) employing the control system to actuate the valve to supply high-pressure gaseous hydrocarbons from the high-pressure gaseous hydrocarbon line to the low-pressure vent line upon sensing an unsafe system event in the flowback system.

C. A flowback system, the flowback system including: 1) a tank, the tank including an inlet, a fluid outlet, and a vent; 2) a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank; 3) a low-pressure vent line coupled between the vent and a first flare tip, the first flare tip configured to burn low-pressure gaseous hydrocarbons received from the tank; 4) an inert gas line coupled between the low-pressure vent line and the first flare tip; and 5) a control system including a sensor, a valve and a valve controller coupled to the valve, the valve of the control system coupled between the low-pressure vent line and the inert gas line, the control system configured to sense an unsafe system event and actuate the valve to supply inert gas from the inert gas line to the low-pressure vent line.

D. A method, the method including: 1) providing a flowback system, the flowback system including: a) a tank, the tank including an inlet, a fluid outlet, and a vent; b) a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank; c) a low-pressure vent line coupled between the vent and a first flare tip, the first flare tip configured to burn low-pressure gaseous hydrocarbons received from the tank; d) an inert gas line coupled between the low-pressure vent line and the first flare tip; and e) a control system including a sensor, a valve and a valve controller coupled to the valve, the valve of the control system coupled between the low-pressure vent line and the inert gas line; and 2) employing the control system to actuate the valve to supply inert gas from the inert gas line to the low-pressure vent line upon sensing an unsafe system event in the flowback system.

Aspects A, B, C, and D may have one or more of the following additional elements in combination: Element 1: wherein the control system is configured to sense the unsafe system event and automatically actuate the valve. Element 2: further including a flame arrester located in-line with the low-pressure vent line between the vent and the first flare tip. Element 3: wherein the valve couples with the low-pressure vent line downstream of the flame arrester. Element 4: wherein the sensor is a first sensor, the valve is a first valve, and the valve controller is a first valve controller, and wherein the control system further includes a second sensor, a second valve coupled between an inert gas line and the low-pressure vent line, and a second valve controller coupled to the second valve, the control system configured to sense one or more different unsafe system events and automatically actuate the second valve to supply inert gas from the inert gas line to the low-pressure vent line. Element 5: wherein the second valve couples with the low-pressure vent line downstream of the flame arrester. Element 6: wherein the one or more different unsafe system events are an increase in temperature, increase in pressure, change in chemical composition, or fire proximate a downstream end of the flame arrester. Element 7: wherein the unsafe system event is a fire proximate a downstream end of the flame arrester. Element 8: wherein the unsafe system event is an activation of the transfer pump. Element 9: wherein the unsafe system event is an undesirably low pressure at the first flare tip. Element 10: wherein the unsafe system event is an undesirably low flowrate at the first flare tip. Element 11: wherein the unsafe system event is an undesirably high pressure at the high-pressure gaseous hydrocarbon line. Element 12: wherein the control system includes a battery backup that is configured to power the control system if power is lost. Element 13: wherein the control system includes a self-powered actuating circuit configured to power the control system if power is lost. Element 14: wherein the self-powered actuating circuit is a thermoelectric circuit that is configured to actuate the valve when encountering a high temperature event. Element 15: further including a high-pressure gaseous hydrocarbon line coupled to a second flare tip, the second flare tip configured to burn high-pressure gaseous hydrocarbons, wherein the sensor is a first sensor, the valve is a first valve, and the valve controller is a first valve controller, and wherein the control system further includes a second sensor, a second valve coupled between high-pressure gaseous hydrocarbon line and the low-pressure vent line, and a second valve controller coupled to the second valve, the control system configured to sense one or more different unsafe system events and automatically actuate the second valve to supply high-pressure gaseous hydrocarbons from the high-pressure gaseous hydrocarbon line to the low-pressure vent line. Element 16: wherein the second valve couples with the low-pressure vent line downstream of the flame arrester. Element 17: wherein the different unsafe system event is a fire proximate a downstream end of the flame arrester. Element 18: wherein the different unsafe system event is an activation of the transfer pump. Element 19: wherein the different unsafe system event is an undesirably low pressure at the first flare tip. Element 20: wherein the different unsafe system event is an undesirably low flowrate at the first flare tip. Element 21: wherein the different unsafe system event is an undesirably high pressure at the high-pressure gaseous hydrocarbon line. Element 22: wherein the one or more different unsafe system events are an increase in temperature, change in pressure, change in chemical composition, or fire proximate a downstream end of the flame arrester. Element 23: wherein the unsafe system event is an increase in temperature or pressure proximate a downstream end of the flame arrester. Element 24: wherein the unsafe system event is a change in chemical composition proximate a downstream end of the flame arrester. Element 25: wherein the unsafe system event is a fire proximate a downstream end of the flame arrester.

Those skilled in the art to which this application relates will appreciate that other and further additions, deletions, substitutions and modifications may be made to the described embodiments.

What is claimed is:

1. A flowback system, comprising a tank, the tank including an inlet, a fluid outlet, and a vent;

a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank;

a low-pressure vent line coupled between the vent and a first flare tip, the first flare tip configured to burn low-pressure gaseous hydrocarbons received from the tank;

a high-pressure gaseous hydrocarbon line coupled to a second flare tip, the second flare tip configured to burn high-pressure gaseous hydrocarbons; and a control system including a sensor, a valve and a valve controller coupled to the valve, the valve of the control system coupled between the low-pressure vent line and the high-pressure gaseous hydrocarbon line, the control system configured to sense an unsafe system event and actuate the valve to supply high-pressure gaseous hydrocarbons from the high-pressure gaseous hydrocarbon line to the low-pressure vent line.

2. The flowback system as recited in claim 1, wherein the control system is configured to sense the unsafe system event and automatically actuate the valve.

3. The flowback system as recited in claim 1, further including a flame arrester located in-line with the low-pressure vent line between the vent and the first flare tip.

4. The flowback system as recited in claim 3, wherein the valve couples with the low-pressure vent line downstream of the flame arrester.

5. The flowback system as recited in claim 3, wherein the sensor is a first sensor, the valve is a first valve, and the valve controller is a first valve controller, and wherein the control system further includes a second sensor, a second valve coupled between an inert gas line and the low-pressure vent line, and a second valve controller coupled to the second valve, the control system configured to sense one or more different unsafe system events and automatically actuate the second valve to supply inert gas from the inert gas line to the low-pressure vent line.

6. The flowback system as recited in claim 5, wherein the second valve couples with the low-pressure vent line downstream of the flame arrester.

7. The flowback system as recited in claim 6, wherein the one or more different unsafe system events are an increase in temperature, increase in pressure, change in chemical composition, or fire proximate a downstream end of the flame arrester.

8. The flowback system as recited in claim 3, wherein the unsafe system event is a fire proximate a downstream end of the flame arrester.

9. The flowback system as recited in claim 1, wherein the unsafe system event is an activation of the transfer pump.

10. The flowback system as recited in claim 1, wherein the unsafe system event is an undesirably low pressure at the first flare tip.

11. The flowback system as recited in claim 1, wherein the unsafe system event is an undesirably low flowrate at the first flare tip.

12. The flowback system as recited in claim 1, wherein the unsafe system event is an undesirably high pressure at the high-pressure gaseous hydrocarbon line.

13. The flowback system as recited in claim 1, wherein the control system includes a battery backup that is configured to power the control system if power is lost.

14. The flowback system as recited in claim 1, wherein the control system includes a self-powered actuating circuit configured to power the control system if power is lost.

15. The flowback system as recited in claim 14, wherein the self-powered actuating circuit is a thermo-electric circuit that is configured to actuate the valve when encountering a high temperature event.

16. A method, comprising:

providing a flowback system, the flowback system including:

a tank, the tank including an inlet, a fluid outlet, and a vent;

a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank;

a low-pressure vent line coupled between the vent and a first flare tip, the first flare tip configured to burn low-pressure gaseous hydrocarbons received from the tank;

a high-pressure gaseous hydrocarbon line coupled to a second flare tip, the second flare tip configured to burn high-pressure gaseous hydrocarbons; and a control system including a sensor, a valve and a valve controller coupled to the valve, the valve of the control system coupled between the low-pressure vent line and the high-pressure gaseous hydrocarbon line; and employing the control system to actuate the valve to supply high-pressure gaseous hydrocarbons from the high-pressure gaseous hydrocarbon line to the low-pressure vent line upon sensing an unsafe system event in the flowback system.

17. The method as recited in claim 16, wherein the unsafe system event is an activation of the transfer pump.

18. The method as recited in claim 16, wherein the unsafe system event is an undesirably low pressure at the first flare tip.

19. The method as recited in claim 16, wherein the unsafe system event is an undesirably low flowrate at the first flare tip.

20. The method as recited in claim 16, wherein the unsafe system event is an undesirably high pressure at the high-pressure gaseous hydrocarbon line.

21. A flowback system, comprising a tank, the tank including an inlet, a fluid outlet, and a vent;

a transfer pump having a transfer pump inlet and a transfer pump outlet, the transfer pump inlet coupled to the fluid outlet of the tank and the transfer pump outlet coupled to a burner head, the burner head configured to burn liquid hydrocarbons received from the tank;

a low-pressure vent line coupled between the vent and a first flare tip, the first flare tip configured to burn low-pressure gaseous hydrocarbons received from the tank;

an inert gas line coupled between the low-pressure vent line and the first flare tip; and a control system including a sensor, a valve and a valve controller coupled to the valve, the valve of the control system coupled between the low-pressure vent line and the inert gas line, the control system configured to sense an unsafe system event and actuate the valve to supply inert gas from the inert gas line to the low-pressure vent line.

22. The flowback system as recited in claim 21, wherein the control system is configured to sense the unsafe system event and automatically actuate the valve.

23. The flowback system as recited in claim 21, further including a flame arrester located in-line with the low-pressure vent line between the vent and the first flare tip.

24. The flowback system as recited in claim 23, wherein the valve couples with the low-pressure vent line downstream of the flame arrester.

25. The flowback system as recited in claim 23, further including a high-pressure gaseous hydrocarbon line coupled to a second flare tip, the second flare tip configured to burn high-pressure gaseous hydrocarbons, wherein the sensor is a first sensor, the valve is a first valve, and the valve controller is a first valve controller, and wherein the control system further includes a second sensor, a second valve coupled between high-pressure gaseous hydrocarbon line and the low-pressure vent line, and a second valve controller coupled to the second valve, the control system configured to sense one or more different unsafe system events and automatically actuate the second valve to supply high-pressure gaseous hydrocarbons from the high-pressure gaseous hydrocarbon line to the low-pressure vent line.

26. The flowback system as recited in claim 25, wherein the second valve couples with the low-pressure vent line downstream of the flame arrester.

27. The flowback system as recited in claim 26, wherein the different unsafe system event is a fire proximate a downstream end of the flame arrester.

28. The flowback system as recited in claim 26, wherein the different unsafe system event is an activation of the transfer pump.

29. The flowback system as recited in claim 26, wherein the different unsafe system event is an undesirably low pressure at the first flare tip.

30. The flowback system as recited in claim 26, wherein the different unsafe system event is an undesirably low flowrate at the first flare tip.

31. The flowback system as recited in claim 26, wherein the different unsafe system event is an undesirably high pressure at the high-pressure gaseous hydrocarbon line.

32. The flowback system as recited in claim 23, wherein the one or more different unsafe system events are an increase in temperature, change in pressure, change in chemical composition, or fire proximate a downstream end of the flame arrester.

33. The flowback system as recited in claim 21, wherein the control system includes a battery backup that is configured to power the control system if power is lost.

34. The flowback system as recited in claim 21, wherein the control system includes a self-powered actuating circuit configured to power the control system if power is lost.

35. The flowback system as recited in claim 34, wherein the self-powered actuating circuit is a thermo-electric circuit that is configured to actuate the valve when encountering a high temperature event.

* * * * *